US006603254B1

(12) United States Patent
Ando

(10) Patent No.: US 6,603,254 B1
(45) Date of Patent: Aug. 5, 2003

(54) HERMETICALLY SEALED CONTAINER AND IMAGE FORMING APPARATUS

(75) Inventor: Tomokazu Ando, Isehara (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/510,150

(22) Filed: Feb. 22, 2000

(30) Foreign Application Priority Data

Mar. 5, 1999 (JP) ..... 11-058440
Feb. 15, 2000 (JP) ..... 2000-037126

(51) Int. Cl.[7] ..... H01J 29/50
(52) U.S. Cl. ..... 313/495; 313/292; 313/634
(58) Field of Search ..... 313/495, 498, 313/497, 512, 292, 581, 634

(56) References Cited

U.S. PATENT DOCUMENTS 4,618,802 A * 10/1986 Schrank ..... 313/512
5,600,203 A * 2/1997 Namikawa et al. ..... 313/495
5,952,775 A * 9/1999 Sato et al. ..... 313/495

FOREIGN PATENT DOCUMENTS

| | | |
|---|---|---|
| EP | 0 660 357 | 6/1995 |
| JP | 7-235255 | 9/1995 |
| JP | 10-188787 | 7/1998 |
| JP | 10-236851 | 9/1998 |

* cited by examiner

*Primary Examiner*—Sandra O'Shea
*Assistant Examiner*—Bao Truong
(74) *Attorney, Agent, or Firm*—Fitzpatrick, Cella, Harper & Scinto

(57) ABSTRACT

A hermetically sealed container includes a front substrate, a back substrate disposed opposite to the front substrate, and an outer frame disposed in a peripheral portion between the front substrate and the back substrate. The front and back substrates and the outer frame are bonded with an adhesive to form a hermetically sealed space. When a ratio W/T of width W and thickness of T of the outer frame is set to an aspect ratio A of the outer frame, 1.5≦A.

16 Claims, 4 Drawing Sheets

HERMETICALLY SEALED CONTAINER AND IMAGE FORMING APPARATUS

BACKGROUND

1. Field of the Invention

The present invention relates to a hermetically sealed container and an image forming apparatus using the hermetically sealed container.

2. Related Background Art

As a flat panel display, a vacuum fluorescent display utilizing a thermionic cathode, an image display utilizing cold cathodes such as a surface conduction electron emitting device, and the like are known.

Such flat panel image forming apparatuses are disclosed, for example, in Japanese Patent Application Laid-Open Nos. 10-236851, 10-188787, and the like. The schematic structure of such flat panel image forming apparatus is shown in FIG. 7. In FIG. 7, numeral 101 denotes a face plate (front substrate), 102 denotes a rear plate (back substrate), 103 denotes an outer frame, and a hermetically sealed container 7 is constituted by bonding the abutment portions of the components 101, 102, 103. In general, the abutment portions are bonded by adhesives such as a frit glass. Moreover, in the image forming apparatus shown in FIG. 7, electrons emitted from an electron source 109 are accelerated by an anode voltage applied to an image forming member 108 such as a phosphor, so that emission and display are performed.

FIG. 4 is a sectional view showing the basic constitution of the vacuum fluorescent display disclosed in the Japanese Patent Application Laid-Open No. 10-236851 among the above-described flat panel displays. In FIG. 4, numeral 14 denotes a front glass, 12 denotes a plate glass disposed opposite to the front glass, and 16 denotes a spacer glass disposed between two glasses at the peripheral edge of the front glass 14 and plate glass 12. These constitute a vacuum fluorescent display 10 as a hermetically sealed container.

In FIG. 4, character W denotes the width of the spacer glass 16, and T denotes thickness. Numeral 24 denotes a filament-like thermionic cathode which emits electrons, 30 denotes a phosphor layer which is irradiated with the electrons to obtain emission, and these components are disposed on the plate glass 12.

SUMMARY

According to the present invention, there is provided a hermetically sealed container comprising: a front substrate; a back substrate disposed opposite to the front substrate; and an outer frame disposed between the front substrate and the back substrate. The front and back substrates, and the outer frame are bonded with an adhesive to form a hermetically sealed space. When a ratio W/T of the width W and thickness T of the outer frame is set to the aspect ratio A of the outer frame, $1.5 \leqq A$.

Moreover, according to the present invention, there is provided an image forming apparatus using a hermetically sealed container comprising: a front substrate having an image forming member and a conductive film; a back substrate disposed opposite to the front substrate and provided with an electron source; and an outer frame disposed between the front substrate and the back substrate. The front and back substrates, and the outer frame are bonded with an adhesive to form a hermetically sealed space. When a ratio W/T of the width W and thickness T of the outer frame is set to the aspect ratio A of the outer frame, $1.5 \leqq A$.

Furthermore, according to the present invention, when the ratio W/T of the width W and thickness T of the outer frame is set to the aspect ratio A of the outer frame, $1.5 \leqq A \leqq 30$.

DETAILED DESCRIPTION OF THE PREFERRED EMBODIMENTS

Figure 4:
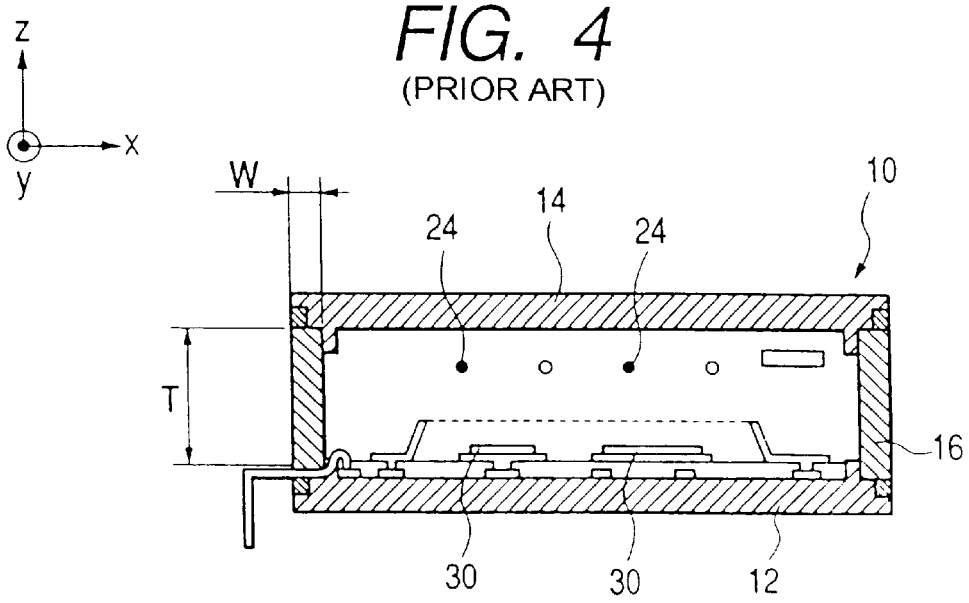
FIG. 4 (PRIOR ART)
FIG. 4 is a sectional view showing a conventional example.
Figure 7:
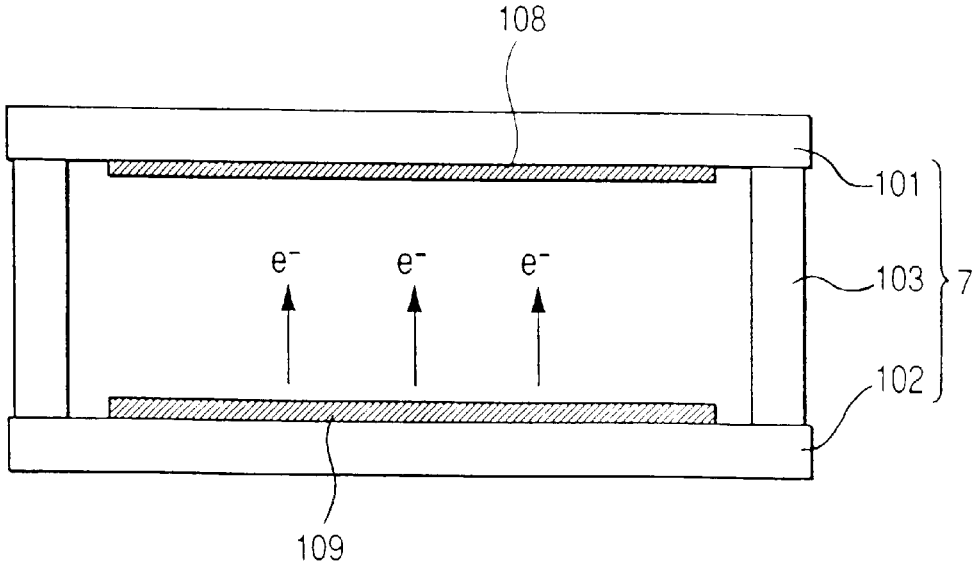
FIG. 7 (PRIOR ART)
FIG. 7 is a schematic view showing the structure of a flat panel image forming apparatus.

When the above-described image forming apparatus shown in FIGS. 4 and 7 is driven, mainly an electron source (109, 24) emitting electrons, and a phosphor (image forming member) 30, 108 irradiated with the electrons generate heat. Therefore, the temperature of the constituting member of a hermetically sealed container in the vicinity of the heating source locally rises. Particularly in the substrate (face plate, rear plate), an in-plane temperature distribution in a thickness direction is generated, non-uniform thermal expansion is therefore generated, and the hermetically sealed container is deformed. One example of deformation in the vacuum fluorescent display will be described hereinafter with reference to FIG. 5.

Figure 5:
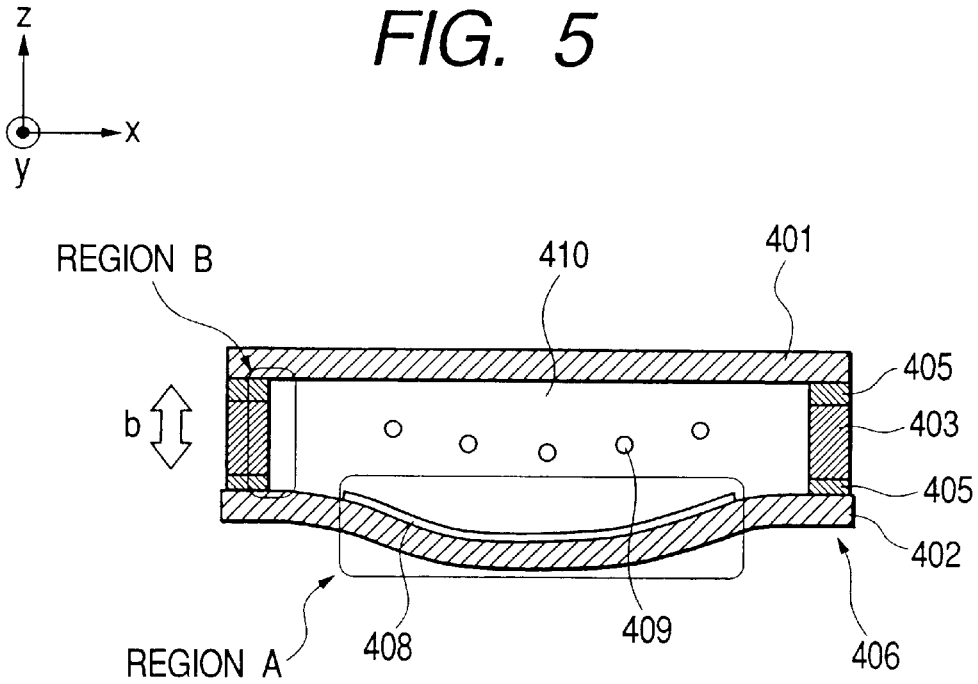
FIG. 5 is a schematic sectional view showing a problem.

FIG. 5 is a schematic sectional view of the hermetically sealed container constituting the vacuum fluorescent display. In FIG. 5, numeral 401 denotes a front substrate, 402 denotes a back substrate disposed opposite to the front substrate 401, and 403 denotes an outer frame (represented as the spacer glass in FIG. 4, but hereinafter referred to as the outer frame) hermetically bonded to the front substrate 401 and the back substrate 402 by an adhesive 405. The outer frame 403 has a width W and a thickness T. Moreover, numeral 406 denotes a hermetically sealed container constituted by the front substrate 401, back substrate 402, and outer frame 403, and 410 denotes a hermetically sealed space. Numeral 409 denotes a filament cathode as the thermionic cathode mounted on the back substrate 402, and 408 denotes a phosphor mounted on the back substrate 402 and irradiated with the electrons generated by the filament cathode 409 to emit light.

In a region A as the central portion of the back substrate 402 the temperature rises by the heat generated by the phosphor 408 and the filament cathode 409, and the back substrate 402 is deformed in -z direction. As a result, a peeling stress $\sigma$ is generated in z direction in a region B of the outer frame 403 and adhesive section 405 for connecting the front substrate 401 and back substrate 402. Additionally, the deformation in the -z direction is drawn in an exaggerated manner for the sake of description.

In the image forming apparatus shown in FIG. 4, the display area is small, and the anode voltage applied to the phosphor 408 is as low as several hundreds of volts. Furthermore, the filament cathode having a very high temperature is held apart from the substrate (in a hollow state). Therefore, the peeling stress a is small, and the above-described deformation raises no problem.

However, in recent years, the image display has been requested to have a larger screen and perform a higher-luminance image display. To meet the new request, it has been desired to set the size of the face plate 101 or the rear plate 102 shown in FIG. 7 to several tens of inches, or to apply a very high anode voltage in a range of several kilovolts to several tens of kilovolts.

For this purpose, the conventional image display is simply enlarged while maintaining the distance between the face plate 101 and the rear plate 102 at several millimeters, and further the anode voltage is raised. In this case, however, when the image display is driven for a long time, a crack leading to slow leak is sometimes produced in the outer frame of the hermetically sealed container and the bonded portion of the outer frame and substrate.

The slow leak means a phenomenon in which the air (gas) outside the hermetically sealed container flows along a micro leak path into the hermetically sealed space, and the vacuum degree of the hermetically sealed space is gradually deteriorated.

In order to apply a high voltage of several kilovolts to several tens of kilovolts between the opposite substrates as described above, the inside of the hermetically sealed container has to be maintained in a very high vacuum state of $10^{-5}$Pa or more, more preferably $10^{-7}$Pa or more. Moreover, the distance between the opposite substrates needs to be suppressed to several millimeters. Therefore, when the slow leak is produced, the performance of the hermetically sealed container is deteriorated, the performance (electric insulating properties between the anode and cathode) of the image display is simultaneously deteriorated, discharge occurs, and the life of the electron emitting device is therefore lowered.

The occurrence of the slow leak is attributed to the enlargement of a heating portion area by the enlarged screen, the increase of calorific value by the high luminance (a substantial rise in anode voltage), and the increase of heating density by high definition.

Therefore, the peeling stress $\sigma$ of the outer frame, which has heretofore caused no problem, is increased, and the slow leak is sometimes generated.

Figure 6:
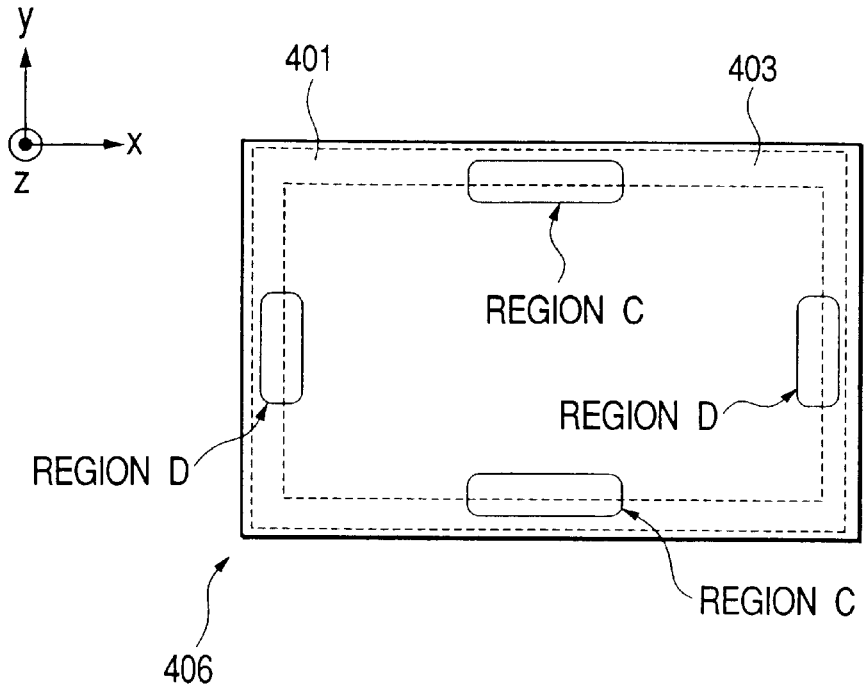
FIG. 6 is a schematic view showing the problem.

The peeling stress $\sigma$ will now be described in detail with reference to FIG. 6 in which the hermetically sealed container 406 is seen from the side of front substrate 401. The peeling stress a has a size distribution in the outer frame 403. The region C corresponds to the central portion of the longitudinal direction of the outer frame 403, and the peeling stress $\sigma$ is maximized in the region C. A region D corresponds to the central portion of the short direction of the outer frame 403, and the peeling stress $\sigma$ of this region is large next to that of the region C. Therefore, in the regions C and D the crack or peel leading to the slow leak is produced, and the slow leak is generated.

The generation of the slow leak of the hermetically sealed container as described above has been an important problem in manufacturing a large-sized, high-luminance, high-definition image display.

To solve the problem, it has been desired to provide an outer frame structure suitable for a hermetically sealed structure, and to provide a hermetically sealed container in which slow leak is not easily generated and an image display using the container.

Figure 3:
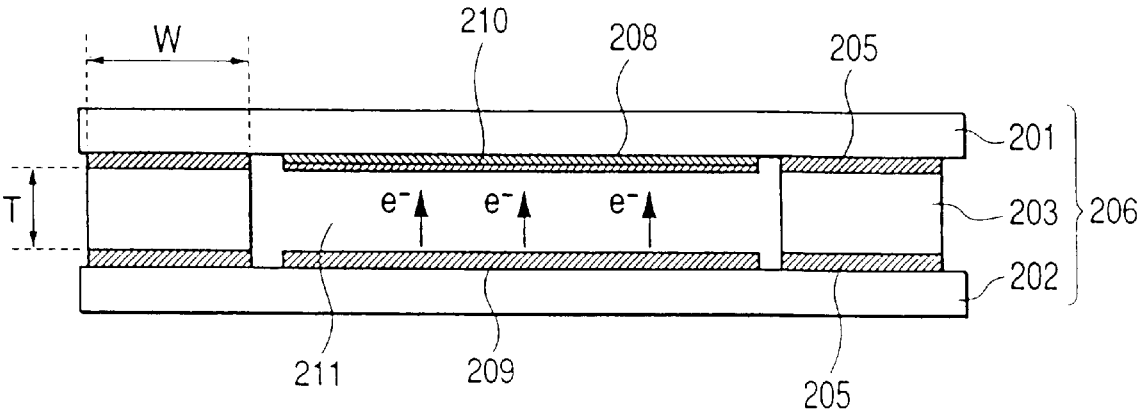
FIG. 3 is a schematic sectional view of the hermetically sealed container showing the present embodiment.

FIG. 3 is a schematic sectional view showing one example of the hermetically sealed container according to the present invention. In FIG. 3, numeral 201 denotes a front substrate (face plate), 202 denotes a back substrate (rear plate) disposed opposite to the front substrate 201, and 203 denotes an outer frame hermetically bonded to the front substrate 201 and the back substrate 202 via an adhesive (bonding member) 205.

The outer frame 203 has a width W and a thickness T. The thickness T is in a range of 1 mm to 10 mm, preferably 1 mm to 5 mm.

Moreover, numeral 206 denotes a hermetically sealed container constituted by the front substrate 201, back substrate 202, and outer frame 203, and 211 denotes a hermetically sealed space. The hermetically sealed space is held in a vacuum degree of $10^{-5}$Pa or more, more preferably $10^{-7}$Pa or more.

Furthermore, the material of the front substrate 201, back substrate 202, and outer frame 203 is preferably glass.

Numeral 209 denotes a cathode (electron source) mounted on the back substrate 202 and comprising a cold cathode. It should be recognized that the electron source according to the present invention comprises one or more electron emitting devices. As the electron source, (a) surface conduction electron emitting device, (a) field emitter, MIM type electron emitting device, and the like can preferably be applied. Particularly, since the surface conduction electron emitting device can easily be formed in a large area, this electron emitting device is most suitable for the present invention.

A phosphor 208 is mounted on the front substrate, and irradiated with electrons emitted from the cathode 209 to emit light. A conductive film (anode electrode, metal back) 210 is disposed on the surface of the phosphor 209 on the rear plate side. A voltage of several kilovolts to several tens of kilovolts (preferably in a range of 1 to 20 kV, more preferably 5 to 15 kV) is applied to the conductive film from the high-voltage power source disposed outside the hermetically sealed container. The thickness of the conductive film 210 is in a range of 30 to 200 nm, preferably 50 to 100 nm.

As described above as the problems, in the present invention, requests were obtained as follows with respect to the aspect ratio (W/T):A in the sectional configuration of the outer frame.

First, study by FEM (finite element method) analysis was performed. The FEM analysis comprises: forming a state for driving the image display, that is, applying a heat to the substrate as the constituting member of the hermetically sealed container and performing heat conduction analysis to form the temperature distribution; and further using the temperature distribution as a thermal load to perform stress analysis, so that the peeling stress $\sigma$ as a thermal stress produced in the outer frame corresponding to the regions B and C, and the bonded portion of the outer frame and substrate was obtained. A first condition required for the outer frame is that the peeling stress $\sigma$ corresponds to the peeling strength of the adhesive (frit glass) and the fracture strength of glass obtained from experiments, and is 12 MPa or less.

Secondly, various outer frames were used to prepare the hermetically sealed container including the heating source in the same state as the state for driving the image display, the deformation of the hermetically sealed container by heating was caused for a long period, and a helium leak detector or the like was used to check the occurrence of slow leak. Here, a second condition is that no slow leak is generated.

From the above-described two conditions, it has been found that the aspect ratio A of the outer frame needs to be $1.5 \leqq A$.

Furthermore, judgment of practicabilities such as the apparatus cost in bonding the outer frame and the weight/cost of outer frame members was performed, and a third condition is that the outer frame be practical.

From these three judgments, $1.5 \leqq A \leqq 30$, $1.5\ \text{mm} \leqq W \leqq 30\ \text{mm}$ is appropriate.

Detailed judgment contents will be described in examples.

One example of a method of manufacturing the image forming apparatus of the present invention will next be described. The method comprises: first forming the red, green and blue phosphor film 208 on the inner surface of the front substrate 201; further forming the conductive film (anode electrode, metal back) 210 on the phosphor film; next disposing the electron source 209, and the like on the back substrate 202; subsequently laminating and arranging the adhesive 205 and the outer frame 203 on the back substrate 202; further placing the front substrate 201; fixing the relative positions of the members with a jig or the like; heating, softening and bonding the adhesive 205 which is frit glass with a hot plate or the like in vacuum; and hermetically sealing and bonding the members. Subsequently, by performing the temperature raising and the removal from the hot plate, the hermetically sealed container 206 provided with the hermetically sealed space 211 is completed.

Even when the temperatures of the front substrate 201 and back substrate 202 rise during the driving of the image display formed as described above, the cracks which can be seen with a 10 times magnifier are not produced in the outer frame 203 and adhesive 205. Additionally, it has been confirmed that no slow leak is generated, and that the hermetically sealed container 206 provided with a stable performance and the image display using the container can be manufactured.

For the material of the front substrate 201 and back substrate 202 a soda-lime glass is preferable because of its low manufacture cost, but glasses such as a high strain point glass, a non-alkali glass, and a pyrex glass may be used.

For the material of the outer frame 203, the same material as that of the front substrate 201 or the back substrate 202 is preferable, but glasses such as the high strain point glass, the non-alkali glass, and the pyrex glass may be used, and ceramics, metals, or metal alloys such as 426 alloy may be used. Moreover, the outer frame 203 may be continuous and integral with either the front substrate 201 or the back substrate. In this case, the front substrate 201 present in the region corresponding to the outer frame 203 is defined as the outer frame.

The adhesive 205 for bonding the outer frame 203 to the front substrate 201 and back substrate 202 may be inorganic adhesives such as frit glass or organic adhesives such as polyimide and epoxy.

Moreover, in the present embodiment, the use of the cold cathode 209 as an electron source 209 has been described, but the present invention is not limited to this, and the filament cathode which is a thermionic cathode may be used. However, since the thermionic cathode has a high calorific value, the above-described cold cathode is preferably used.

EXAMPLE 1

This is an example in which the object is attained against the problem in the enlarged screen of the image display.

Figure 1:
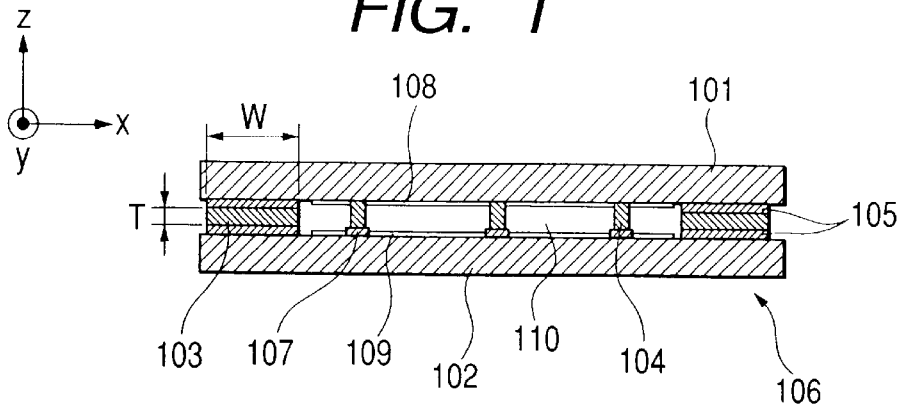
FIG. 1 is a schematic sectional view of a hermetically sealed container showing an image forming apparatus prepared in an embodiment.
Figure 2:
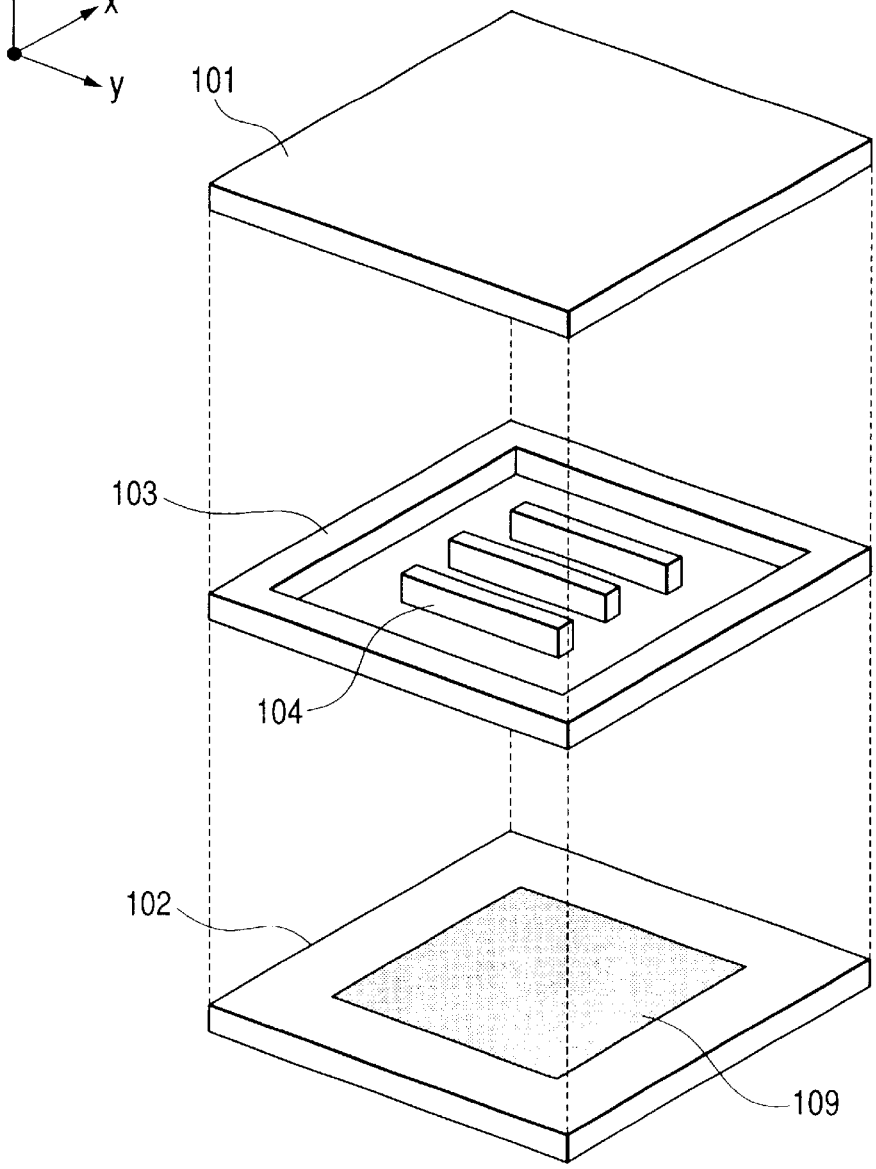
FIG. 2 is a schematic perspective view of the image forming apparatus prepared in the embodiment.

FIGS. 1 and 2 are explanatory views of a first example according to the present invention. FIG. 1 is a schematic sectional view of the hermetically sealed container, and FIG. 2 is a schematic perspective view in which the constituting members of the hermetically sealed container are exploded.

In the drawings, numeral 101 denotes a front substrate (thickness of 2.8 mm), 102 denotes a back substrate (thickness of 2.8 mm) disposed opposite to the front substrate 101, and 103 denotes an outer frame hermetically bonded to the front substrate 101 and back substrate 102 by a frit glass 105. The outer frame 103 has a width W of 3 mm, thickness T of 1 mm, and aspect ratio A of 3. Moreover, the thickness of the frit glass 105 is 0.2 mm.

Numeral 104 denotes a spacer for suppressing the deformation of the hermetically sealed container against the atmospheric pressure applied from the outside when the hermetically sealed container 106 is evacuated. For the size, the length t of x-direction is 0.2 mm, the length of y-direction is 40 mm, and the length of z-direction is 1.2 mm. The spacer is fixed only to the back substrate 102 via a frit glass 107 (thickness of 0.2 mm) (only abuts on the front substrate 101). In FIGS. 1, 2, only three spacers are shown, but there are actually 250 spacers.

Numeral 106 denotes a hermetically sealed container constituted of the front substrate 101, the back substrate 102 and outer frame 103. Numeral 110 denotes a hermetically sealed space. The size of the hermetically sealed container 106 is 900 mm in the x-direction, 580 mm in the y-direction, and 7 mm in the z-direction. Moreover, the materials of the front substrate 101, back substrate 102, outer frame 103, and spacer 104 are soda-lime glasses.

Numeral 109 denotes (a) surface conduction electron emitting devices mounted on the back substrate 102 as an electron source, and 108 denotes a phosphor mounted on the front substrate and irradiated with the electrons emitted by the surface conduction electron emitting device 109 to emit light. The detailed technique on the surface conduction electron emitting device 109 is disclosed in Japanese Patent Application Laid-Open No. 7-235255, and the like.

A method of manufacturing the image forming apparatus of the present example will next be described. The method comprises: first forming the phosphor 108 on the front substrate 101; further forming a metal back of Al in a thickness of 60 nm; subsequently disposing the surface conduction electron emitting devices 109, and the like on the back substrate 102; thereafter laminating and arranging the frit glass 105 and outer frame 103 on the back substrate 102; further positioning and arranging the spacer 104 and frit glass 107 with a jig; applying loads to the outer frame 103 and spacer 104; heating the components up to the bonding temperature of the frit glass 105 in a hot plate; and bonding and cooling the components. Furthermore, the method comprises: placing the frit glass 105 and front substrate 101 on the outer frame 103; fixing the components in appropriate positions with the jig or the like; heating the components to the bonding temperature of the frit glass 105 in the hot plate; applying the load to the frit glass 105; and hermetically bonding the components. Subsequently, by raising the temperature and removing the components from the hot plate, the container 106 provided with the space 110 was completed.

Subsequently, by exhausting the air (gas) from the space 110 via an exhaust tube (not shown) to obtain vacuum, connecting the surface conduction electron emitting devices 109 to an exterior drive circuit (not shown), and supplying power to the surface conduction electron emitting devices 109, an electron emitting region was formed. Thereafter, by sealing the exhaust tube (not shown), the hermetically sealed container was obtained.

Next, by connecting the exterior drive circuit to the hermetically sealed container, and applying a voltage of 10 kV to the metal back, with reference to the electron source (electron emitting device), the image forming apparatus was driven for a long time. Even when the temperatures of the front substrate 101 and back substrate 102 were raised, no slow leak was caused in the outer frame 103 and frit glass 105, so that the stable hermetically sealed container and image display could be obtained.

Subsequently, the FEM analysis was performed on the outer frames having widths W=1, 1.5, 2, 5, 30, 40 mm using a thickness T of 1 mm as a target and centering on the width W=3 mm of the outer frame 103 as the above-described first condition. A judgment criterion was the peeling stress σ of 12 MPa or less at which the crack leading to the slow leak was considered not to occur. Moreover, the outer frames having the widths W=1, 1.5, 2, 5, 30, 40 mm of the outer frame 103 were used to form the hermetically sealed container, the container was driven as the image display, the slow leak was checked using the helium leak detector particularly in the regions C and D, and it was confirmed that there was no slow leak.

Moreover, when the width W of the outer frame increases, the load necessary for heating/bonding the outer frame with the front substrate and back substrate using the frit glass 105 increases during manufacture of the hermetically sealed container, the manufacture device is much worn, and the manufacture cost increases. Therefore, it is practically appropriate that the width W is in a range of 1.5 to 30 mm. Results are shown in Table 1.

In the present example, it was indicated by performing the study and manufacture that in the hermetically sealed container having a large screen and the image display using the container, when the aspect ratio (W/T):A of the outer frame 103 was $1.5 \leqq A \leqq 30$ in the frame width W of 1.5 mm$\leqq$W$\leqq$30 mm, this was a practical range, and the slow leak was not easily caused.

Moreover, the spacer 104 having a length of 40 mm and thickness of 0.2 mm was used in the present example, but the configuration and size are not limited to this. For example, the length may be 200 mm, the thickness may be 0.1 mm, or a cylindrical shape with a radius of about 0.1 mm may be used.

EXAMPLE 2

Similarly to the first example, this is an example in which the object is attained against the problem in the enlarged screen of the image display.

The present example is different from the first example only in the size of the outer frame 103 and spacer 104, and is the same as the first example in the sizes of the other constituting members.

In the present example, the outer frame 103 has a width W of 12 mm, thickness T of 3 mm, and aspect ratio A of 4. Accordingly, the length of the z-direction of the spacer 104 is 3.2 mm.

Moreover, the thickness of the frit glass 105 is 0.2 mm. Moreover, the material of the front substrate 101, back substrate 102, outer frame 103 and spacer 104 is a high distortion point glass.

These members were used to manufacture the hermetically sealed container in the same method as that of the first example, then the image display was manufactured, and it was confirmed that there was no slow leak during the drive in a maximum ability.

Furthermore, by varying the thickness T to T=2, 4 mm centering on T=3 mm with respect to the width W=12 mm of the outer frame, the hermetically sealed container, then the image display were manufactured, and the study and confirmation were performed in a similar manner as the first example. Results are shown in Table 2. Additionally, when the thickness T was changed, the length of the z-direction of the spacer 104 was also changed to 2.2 mm, 4.2 mm.

In the present example, it was indicated by performing the study and manufacture that in the hermetically sealed flat container with the large screen and the image display using the container, also when a thickness T of an outer frame, if $1.5 \leqq A$, the slow leak was hardly caused.

EXAMPLE 3

Figure 8:
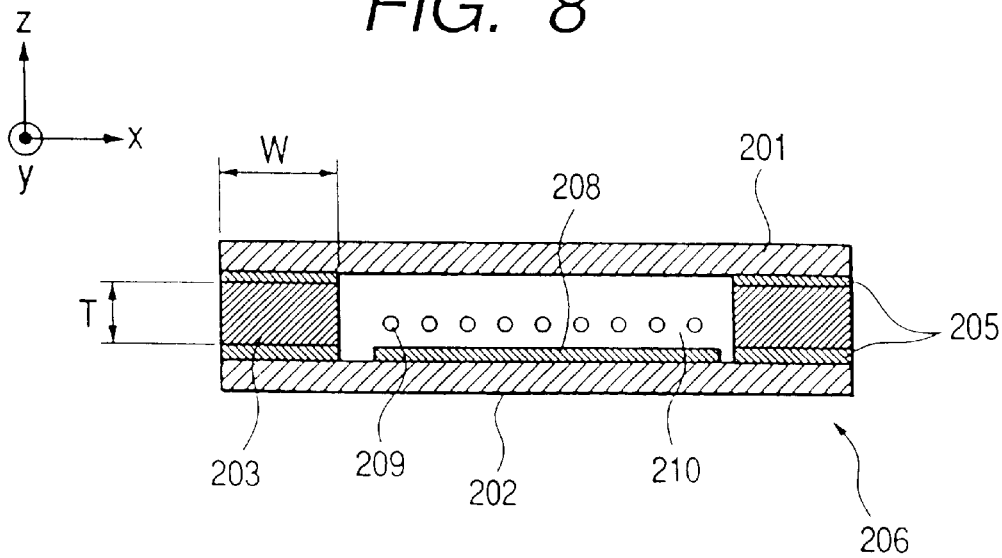
FIG. 8 is a schematic view showing the image forming apparatus prepared in the embodiment.

FIG. 8 is an explanatory view showing the present example. FIG. 8 is a schematic sectional view of the hermetically sealed container, and in FIG. 8, numeral 201 denotes a back substrate (thickness of 2.8 mm), 202 denotes a front substrate (thickness of 2.8 mm) disposed opposite to the back substrate 201, and 203 denotes an outer frame hermetically bonded to the front substrate 202 and the back substrate 201 via a polyimide adhesive 205 (thickness of 0.2 mm). The outer frame 203 has a width W of 10 mm, thickness T of 5 mm, and aspect ratio A of 2. Numeral 206 denotes a hermetically sealed container constituted by the front substrate 202, back substrate 201, and outer frame 203, and 210 denotes a hermetically sealed space. The size of the hermetically sealed space 206 is 250 mm in the x-direction, 50 mm in the y-direction, and 11 mm in the z-direction.

The material of the front substrate 202, back substrate 201, and outer frame 203 is a soda-lime glass.

Numeral 209 denotes a filament as a thermionic cathode mounted on the back substrate 202, and 208 denotes a phosphor mounted on the front substrate 202 and irradiated with the electrons emitted from the filament 209 to emit light. In the present example, since the details such as the phosphor section are the same as those of the conventional example, the description thereof is omitted. In the present example, in order to enhance the luminance than before, the voltage for accelerating the thermions was set to be double the conventional voltage, and to obtain the high definition, the number of filaments 209 was set to be approximately double the conventional number.

A manufacture method will next be described. The method comprises: first forming the red, green and blue filter film (not shown) on the inner surface of the front substrate 202; further forming a transparent ITO film (not shown) as an anode and the phosphor 208 on the filter film; next disposing the cathode (electron source) 209, and the like on the back substrate 201; subsequently laminating and arranging the adhesive 205 and outer frame 203 on the back substrate 201; further placing the front substrate 202; fixing the relative positions of the members with a jig or the like; performing the heating in a hot plate or the like until the adhesive 205 hardens; and hermetically sealing and bonding the members. Subsequently, by performing the temperature raising and the removal from the hot plate, the container 206 provided with the hermetically sealed space 210 was completed.

A method of manufacturing the image display utilizing the container 206 will next be described. The method comprises: first exhausting the air (gas) from the space 210 using an exhaust tube (not shown) to obtain vacuum; connecting the filament 209 to an external drive circuit (not shown), and the like; and supplying power to the filament 209 so that the performance as the electron emitter was given. Thereafter, by sealing the exhaust tube (not shown), the hermetically sealed container was obtained.

Subsequently, the hermetically sealed container was connected to the external drive circuit, and the container was driven as the image forming apparatus. Even when the temperatures of the front substrate 202 and back substrate 201 rose, no slow leak was caused in the outer frame 203 and frit glass 205, so that the stable hermetically sealed container and image display could be obtained.

Subsequently, the FEM analysis was performed on the outer frames 203 having widths W=5, 7.5, 30, 40 mm using a thickness T=5 mm as a target and centering on the width W=10 mm as the above-described first condition. The judgment criterion was the peeling stress σ of 12 MPa or less at which the crack leading to the slow leak was considered not to occur. Moreover, the outer frames with W=7.5, 30, 40 mm were used to form the hermetically sealed container, and further the image display was manufactured.

Moreover, the drive of the maximum ability was performed, the slow leak was checked using the helium leak detector, and it was confirmed that there was no slow leak.

Furthermore, when the frame width W increases, the weight of the outer frame 203 accordingly increases, and the member cost increases. Therefore, the outer frame width W of 30 mm or less is practically appropriate.

Results are shown in Table 1.

In the present example, it was indicated by performing the study and manufacture that in the hermetically sealed container aiming at the high-luminance, high-definition display and the image display using the container, when the outer frame aspect ratio A was 1.5≦A≦6, and the frame width W was 7.5≦W≦30, the slow leak was not easily caused.

As described above, according to the present invention, there is provided an outer frame structure in which the crack leading to the slow leak is not easily generated in the bonded portion of the outer frame and substrates, and there can be manufactured the hermetically sealed container provided with the stable performance and the image display using the container and having a long life of electron emitting source.

TABLE 1

| Item | Judgment | | | | | | | Judgment Criterion |
|---|---|---|---|---|---|---|---|---|
| Outer frame width [mm] | 1 | 1.5 | 2 | 3 | 5 | 30 | 40 | Measured value |
| Thickness T [mm] | 1 | 1 | 1 | 1 | 1 | 1 | 1 | Measured value |
| Aspect ratio | 1 | 1.5 | 2 | 3 | 5 | 30 | 40 | W/T |
| FEM analysis | x | ○ | ○ | ○ | ○ | ○ | ○ | x: stress σ > 12 MPa<br>○: stress σ ≦ 12 MPa |
| Drive | x | ○ | ○ | ○ | ○ | ○ | ○ | x: not performed<br>○: no leak |
| Practicability | | ○ | ○ | ○ | ○ | ○ | Δ | Δ: impractical<br>○: practical |

first condition in the first example

TABLE 2

| Item | Judgment | | | Judgment Criterion |
|---|---|---|---|---|
| Outer frame width [mm] | 12 | 12 | 12 | Measured value |
| Thickness T [mm] | 2 | 3 | 4 | Measured value |
| Aspect ratio A | 6 | 4 | 3 | W/T |
| FEM analysis | ○ | ○ | ○ | x: stress σ > 12 MPa<br>○: stress σ ≦ 12 MPa |
| Drive | ○ | ○ | ○ | x: not performed<br>○: no leak |

TABLE 2-continued

| Item | Judgment | | | Judgment Criterion |
|---|---|---|---|---|
| Practicability | ○ | ○ | ○ | Δ: impractical<br>○: practical |

first condition in the second example

TABLE 3

| Item | Judgment | | | | | | Judgment Criterion |
|---|---|---|---|---|---|---|---|
| Outer frame width [mm] | 5 | 7.5 | 10 | 20 | 30 | 40 | Measured value |
| Thickness T [mm] | 5 | 5 | 5 | 5 | 5 | 5 | Measured value |
| Aspect ratio A | 1 | 1.5 | 2 | 4 | 6 | 8 | W/T |
| FEM analysis | x | ○ | ○ | ○ | ○ | ○ | x: stress σ > 12 MPa<br>○: stress σ ≦ 12 MPa |
| Drive | x | ○ | ○ | ○ | ○ | ○ | x: not performed<br>○: no leak |
| Practicability | | ○ | ○ | ○ | ○ | Δ | Δ: impractical<br>○: practical |

first condition in the third example

What is claimed is:

1. An image forming apparatus using a hermetically sealed container comprising:

a front substrate provided with an image forming member and a conductive film;

a back substrate disposed opposite to said front substrate and provided with an electron source; and an outer frame disposed between said front substrate and said back substrate, with said front substrate, said back substrate, and said outer frame being bonded with an adhesive to form a hermetically sealed space, with said adhesive arranged between said outer frame and said front substrate and between said outer frame and said back substrate, wherein when a ratio W/T of width W and thickness of T of said outer frame is set to an aspect ratio A of said outer frame, 1.5≦A, with the width W measured in a direction substantially parallel with planar surfaces of said front and back substrate, and T being in a range 1–10 mm.

2. The image forming apparatus according to claim 1, wherein a voltage of 1 kV to 20 kV with reference to said electron source is applied to said conductive film.

3. The image forming apparatus according to claim 1, wherein said hermetically sealed space is held in a vacuum of $10^{-5}$ Pa or more.

4. The image forming apparatus according to claim 3, wherein said hermetically sealed container comprises a spacer for supporting an atmospheric pressure inside.

5. The image forming apparatus according to claim 1, wherein the width W of said outer frame is 1.5 mm≦W.

6. The image forming apparatus according to claim 1, wherein the width W of said outer frame is 1.5 mm≦W≦30 mm.

7. The image forming apparatus according to claim 1, wherein the aspect ratio A of said outer frame is 1.5≦A≦30.

8. The image forming apparatus according to any one of claims 1 to 7, wherein said electron source is a surface conduction electron emitting element.

9. The image forming apparatus according to any one of claims 1 to 7, wherein said electron source is a field emitter electron emitting element.

10. A hermetically sealed container comprising:

a front substrate;

a back substrate disposed opposite to said front substrate; and an outer frame disposed between said front substrate and said back substrate, with said front substrate, said back substrate, and said outer frame being bonded with an adhesive to form a hermetically sealed space, with said adhesive arranged between said outer frame and said front substrate and between said outer frame and said back substrate, wherein when a ratio W/T of width W and thickness T of said outer frame is set to an aspect ratio A of said outer frame, $1.5 \leqq A$, with the width W measured in a direction substantially parallel with planar surfaces of said front and back substrate, and T being in a range 1–10 mm.

11. The hermetically sealed container according to claim 10, wherein the aspect ratio A of said outer frame is $1.5 \leqq A \leqq 30$.

12. The hermetically sealed container according to claim 10 or 11, wherein the width W of said outer frame is 1.5 mm$\leqq$W.

13. The hermetically sealed container according to claim 10 or 11, wherein the width W of said outer frame is 1.5 mm$\leqq$W$\leqq$30 mm.

14. The hermetically sealed container according to claim 10 or 11, further comprising a spacer for supporting an atmospheric pressure inside.

15. The hermetically sealed container according to claim 12, further comprising a spacer for supporting an atmospheric pressure inside.

16. The hermetically sealed container according to claim 13, further comprising a spacer for supporting an atmospheric pressure inside.

* * * * *

UNITED STATES PATENT AND TRADEMARK OFFICE

CERTIFICATE OF CORRECTION

PATENT NO. : 6,603,254 B1
DATED : August 5, 2003
INVENTOR(S) : Tomokazu Ando

It is certified that error appears in the above-identified patent and that said Letters Patent is hereby corrected as shown below:

Column 3,
Lines 4 and 49, “stress a” should read -- stress σ --.

Column 8,
Line 31, “back substrate 202,” should read -- back substrate 201, --.

Column 9,
Line 14, “with” should read -- with widths --.

Signed and Sealed this

Sixth Day of January, 2004

JAMES E. ROGAN
*Director of the United States Patent and Trademark Office*